US011305326B2

(12) United States Patent
Olsson et al.

(10) Patent No.: US 11,305,326 B2
(45) Date of Patent: Apr. 19, 2022

(54) PROCESS AND SYSTEM FOR PRESSURE FORMING OF A WORKPIECE

(71) Applicant: Quintus Technologies AB, Vasteras (SE)

(72) Inventors: Sture Olsson, Västerås (SE); Mikael Bergkvist, Västerås (SE); Carolina Nilsson, Västerås (SE); Bjorn Carlsson, Västerås (SE); Hans Hedstrom, Västerås (SE)

(73) Assignee: QUINTUS TECHNOLOGIES AB, Vasteras (SE)

( * ) Notice: Subject to any disclaimer, the term of this patent is extended or adjusted under 35 U.S.C. 154(b) by 486 days.

(21) Appl. No.: 16/315,725

(22) PCT Filed: Jul. 8, 2016

(86) PCT No.: PCT/EP2016/066295
§ 371 (c)(1),
(2) Date: Jan. 7, 2019

(87) PCT Pub. No.: WO2018/006977
PCT Pub. Date: Jan. 11, 2018

(65) Prior Publication Data

US 2019/0329311 A1 Oct. 31, 2019

(51) Int. Cl.
*B21D 22/10* (2006.01)
*B30B 15/34* (2006.01)
(Continued)

(52) U.S. Cl.
CPC ..... *B21D 22/10* (2013.01); *B30B 5/02* (2013.01); *B30B 15/024* (2013.01); *B30B 15/34* (2013.01)

(58) Field of Classification Search
CPC ..... B21D 22/10; B21D 37/16; B21D 37/10; B30B 15/34
See application file for complete search history.

(56) References Cited

U.S. PATENT DOCUMENTS 3,546,221 A 12/1970 Johnson
3,614,811 A 10/1971 Johnson
(Continued)

FOREIGN PATENT DOCUMENTS

CN 103465503 A 12/2013
CN 105149448 A 12/2015
(Continued)

OTHER PUBLICATIONS

International Search Report PCT/ISA/210 for International Application No. PCT/EP2016/066295 dated May 11, 2017.
(Continued)

*Primary Examiner* — Teresa M Ekiert
(74) *Attorney, Agent, or Firm* — Harness, Dickey & Pierce, P.L.C.

(57) ABSTRACT

A process and a system for forming of a workpiece using a press including a pressure generator, a forming tool, and an at least in part elastically deformable element, are disclosed. At least one of the workpiece or the forming tool is heated, and the workpiece is formed using the press so as to obtain a formed workpiece. The heating of at least one of the workpiece or the forming tool is such that the temperature of the at least one of the workpiece or the forming tool during the forming of the workpiece by way of forming pressure generated by the pressure generator is higher than the ambient temperature.

24 Claims, 3 Drawing Sheets

(51) Int. Cl.
*B30B 5/02* (2006.01)
*B30B 15/02* (2006.01)

(56) References Cited

U.S. PATENT DOCUMENTS

| | | | | |
|---|---|---|---|---|
| 3,701,190 | A | 10/1972 | Stone, Jr. | |
| 4,711,111 | A | 12/1987 | Hellgren | |
| 5,494,546 | A | 2/1996 | Horvath | |
| 2012/0152410 | A1* | 6/2012 | Sikora | B21D 37/16 148/530 |
| 2014/0345793 | A1 | 11/2014 | Micarelli | |

FOREIGN PATENT DOCUMENTS

| | | | |
|---|---|---|---|
| DE | 102013020646 | A1 | 6/2015 |
| EP | 0238981 | A1 | 9/1987 |
| EP | 1666170 | A1 | 6/2006 |
| GB | 2094691 | A | 9/1982 |
| IT | 1150327 | B | 12/1986 |
| JP | 2009136911 | A | 6/2009 |
| KR | 101621239 | B1 | 5/2016 |
| WO | WO-03/095186 | A1 | 11/2003 |
| WO | WO-2005021178 | A1 | 3/2005 |
| WO | WO-2010130879 | A1 | 11/2010 |

OTHER PUBLICATIONS

Written Opinion of the International Searching Authority PCT/ISA/237 for International Application No. PCT/EP2016/066295 dated May 11, 2017.

Written Opinion of the International Preliminary Examining Authority PCT/IPEA/408 for Internnational Application No. PCT/EP2016/066295 dated Jun. 27, 2018.

Written Opinion of the International Preliminary Examining Authority PCT/IPEA/408 for International Application No. PCT/EP2016/066295 dated Oct. 24, 2018.

International Preliminary Report on Patentability PCT/IPEA/409 for International Application No. PCT/EP2016/066295 dated Dec. 6, 2018.

Chinese Office Action dated Jun. 16, 2020.

Japanese Office Action and English translation thereof dated Jul. 21, 2020.

Japanese Office Action and English translation thereof dated Mar. 2, 2021.

Office Action for European Patent Application No. 16738728.1 dated Aug. 27, 2021.

* cited by examiner

PROCESS AND SYSTEM FOR PRESSURE FORMING OF A WORKPIECE

TECHNICAL FIELD

The present invention generally relates to the field of pressure treatment. Specifically, the present invention relates to a process and a system for forming of a workpiece using a press, wherein pressure is applied so as to cause one side of the workpiece to be pressed against forming tool such that the workpiece is formed in accordance with the shape of the forming tool.

BACKGROUND

Presses, for example presses of pressure cell type are used among other things when forming sheet-shaped blanks or workpieces, for example sheets of steel or aluminium, into products used e.g. in the aerospace and automotive industries. In presses of pressure cell type, fluid pressure for example of the order of hundreds of bar may be applied to a resilient diaphragm (e.g., made of rubber) to form the blank or workpiece to the shape of a tool or forming means against which the blank or workpiece is formed by the fluid pressure. An example of presses of pressure cell type is the so called Flexform—or fluid cell forming—presses for sheet metal forming which are produced by the Applicant.

SUMMARY

The Flexform type of presses are generally capable of maximum operating pressures between about 80-200 MPa.

A press of pressure cell type generally comprises a force-absorbing press body defining a press chamber. According to one example, in an upper part of the press chamber a press plate and a diaphragm of rubber or another resilient material are arranged, which together form a pressure cell. The pressure cell communicates with a source of pressure and expands when a pressure medium is supplied. In the lower part of the press chamber a structural support or a tray is usually arranged, which may comprise a bottom plate having a tray frame. The tray may support a forming tool, a workpiece or blank to be formed (or machined), and, generally, a mat of rubber or another resilient material covering the forming tool and the blank. When forming sheet-shaped blanks or workpieces, the sheet may be placed in the press such that one of the sides of the sheet faces the forming tool. A resilient membrane or diaphragm may be arranged on the other side of the sheet. A closed space between the diaphragm and the press plate located above the diaphragm constitutes the pressure cell. The closed space is filled with a pressure medium, such as, for example, mineral oil, during the forming process. By introducing additional pressure medium into the pressure cell, the pressure is increased in the pressure cell, whereby the resilient diaphragm is caused to expand downwardly into the tray and to apply forming pressure to the sheet positioned over the tray. Thus, the resilient diaphragm is pressed during stretching against the sheet which, in its turn, increasingly or even completely conforms to (or fits with) the shape of the forming tool. By the resilient diaphragm being pressed during stretching against the sheet, the resilient diaphragm may form the sheet into and around any features of the forming surface of the forming tool. The pressure in the pressure cell is then released (or is possibly maintained until some period of time has passed), whereupon the resilient diaphragm may return to its unstretched position. The resilient diaphragm may then be removed, after which the formed component can be taken out of the press.

Instead of using a resilient membrane or diaphragm for forming the workpiece or blank, by way of fluid pressure pressurizing the resilient diaphragm as described in the foregoing, an elastically deformable pad or flexible cushion, such as, for example, a rubber pad, may be used. A press employing such a pad or cushion may operate similarly to a press of pressure cell type as described in the foregoing, but may not require a pressure cell in which pressure medium is introduced in order to apply forming pressure to the workpiece or blank. Instead, when forming blanks or workpieces, the workpiece or blank is placed in the press such that one of the sides of the workpiece or blank faces the forming tool, and the other side faces the pad or cushion. The pad or cushion may then be pressed against the blank or workpiece by means of some pressure generating means, e.g., a ram, mechanically connected to the pad or cushion. By the deformability of the elastically deformable pad or cushion, it may be deformed so as to cause the side of the blank or workpiece to be pressed against the forming tool such that the workpiece is formed substantially or even completely in accordance with the shape of the surface of the forming tool, similarly to the press of pressure cell type as described in the foregoing. By deformation of the pad or cushion so as to cause the side of the blank or workpiece to be pressed against the forming tool, the pad or cushion may form the blank or workpiece into and around any surface features of the forming surface of the forming tool.

Experimental studies that have been made by the Applicant have indicated that in such 'flexible' forming of a workpiece, employing an at least in part elastically deformable element such as, for example, a resilient membrane or diaphragm, an elastically deformable pad, or an elastically deformable cushion such as described in the foregoing, it may be beneficial to carry out the forming of the workpiece at elevated temperatures. For example, the workpiece and/or the forming tool may be heated such that the temperature of the workpiece and/or the forming tool during the forming of the workpiece is elevated as compared to the ambient temperature (e.g., between 200° C. and 500° C., such as between 250° C. and 350° C., or between 250° C. and 300° C.).

For example in the aerospace industry, aluminium-based components are often used. It is possible to produce high-quality, aluminium-based components using 'cold' flexible forming (i.e., using flexible forming such as described in the foregoing, but where the forming of the workpiece is not carried out while the workpiece is heated to an elevated temperature). However, the use of components made of composites or metallic alloys, such as titanium alloys, is expected to increase in the aerospace industry, whereas the use of the traditional aluminium components in the aerospace industry is expected to decrease. It may however present a challenge to produce components of composites or metallic alloys, such as titanium alloys, using cold flexible forming, which components are of sufficient quality e.g. for use in the aerospace industry. For example, titanium alloys generally have a relatively high strength, and it may be challenging to form a titanium alloy workpiece into compliance with the desired or required shape of the component using 'cold' flexible forming. Components of composites or metallic alloys, such as titanium alloys, are expected to be useful also in other industries, such as the automotive industry. The experimental studies carried out by the Applicant indicate that 'flexible' forming of the workpiece at elevated temperatures may facilitate or even allow for forming of workpieces made of composites or metallic alloys, such as titanium alloys, wherein the thus formed workpieces—or components—have a sufficient quality (e.g., with respect to compliance with the desired or required shape of the component) for example for use in the automotive or aerospace industry.

In view of the above, a concern of the present invention is to provide a process and a system for high-pressure forming of a workpiece which may be made of composites or metallic alloys, such as titanium alloys, wherein the thus formed workpieces have a sufficient quality e.g. for use in the automotive or aerospace industry.

To address at least one of this concern and other concerns, a process and a system in accordance with the independent claims are provided. Preferred embodiments are defined by the dependent claims.

According to a first aspect there is provided a method or a process for forming of a workpiece, or blank, using a press that comprises a pressure generator, a forming tool, and an at least in part elastically deformable element. During forming of the workpiece, the workpiece is arranged adjacent to the forming tool and the elastically deformable element, and between one side of the elastically deformable element and a forming surface of the forming tool so that one side of the workpiece faces the elastically deformable element and another side of the workpiece faces the forming tool. The pressure generator is configured to (possibly controllably) exert a forming pressure of at least 5 MPa (or thereabout, possibly at least one or a few MPa) on the elastically deformable element and/or the forming tool so as to pressurize at least one of one side of the elastically deformable element opposite to the side of the elastically deformable element facing the workpiece, or the forming tool (e.g., a surface of the forming tool opposite to the forming surface). The pressurization of the at least one of the side of the elastically deformable element or the forming tool causes the elastically deformable element to deform so as to cause the side of the workpiece facing the forming tool and the forming surface to be pressed against each other such that the workpiece is formed at least in part in accordance with the shape of the forming surface. The process comprises heating at least one of the workpiece or the forming tool, and forming the workpiece using the press so as to obtain a formed workpiece. The heating of at least one of the workpiece or the forming tool is such that the temperature of the at least one of the workpiece or the forming tool during the forming of the workpiece by way of the forming pressure is higher than the ambient temperature.

According to a second aspect, there is provided a system for forming of a workpiece. The system comprises a press and a heating device. The press comprises a pressure generator, a forming tool, and an at least in part elastically deformable element. During forming of the workpiece, the workpiece is arranged adjacent to the forming tool and the elastically deformable element and between one side of the elastically deformable element and a forming surface of the forming tool so that one side of the workpiece faces the elastically deformable element and another side of the workpiece faces the forming tool. The pressure generator is configured to (possibly controllably) exert a forming pressure of at least 5 MPa on the elastically deformable element and/or the forming tool so as to pressurize at least one of one side of the elastically deformable element opposite to the side of the elastically deformable element facing the workpiece, or the forming surface (e.g., a surface of the forming tool opposite to the forming surface). The pressurization of the at least one of the side of the elastically deformable element or the forming tool causes the elastically deformable element to deform so as to cause the side of the workpiece facing the forming tool and the forming surface to be pressed against each other such that the workpiece is formed at least in part in accordance with the shape of the forming surface, so as to obtain a formed workpiece. The heating device is configured to heat at least one of the workpiece or the forming tool such that the temperature of the at least one of the workpiece or the forming tool, during the forming of the workpiece by way of the forming pressure, is higher than the ambient temperature.

Thus, according to the first and second aspects, the workpiece is formed by means of 'flexible' forming, wherein the workpiece and/or the forming tool have been heated to an elevated temperature, and the forming is carried out while the workpiece and/or the forming tool are at a temperature higher than the ambient temperature. As mentioned in the foregoing, experimental studies which have been carried out by the Applicant have indicated that such 'flexible' forming may facilitate or even allow for forming of workpieces made of composites or metallic alloys, such as titanium alloys, wherein the thus formed workpieces—or components—have a sufficient quality for example for use in the automotive or aerospace industry. As an example, titanium alloys generally have a relatively high strength, and it may be challenging to form titanium alloy workpieces into compliance with the desired or required shape of the component using 'cold' flexible forming.

In the context of the present application, by an elastically deformable element it is meant that the element may deform when (sufficiently high) pressure is applied to the element, and that when the pressure ceases to be applied to the element, the element elastically returns to its initial shape. The elastically deformable element may for example comprise a resilient membrane or diaphragm, a pad (or pressure pad), or a cushion such as described in the foregoing. The elastically deformable element may for example be constituted by or include natural and/or synthetic rubber. As a non-limiting example, the elastically deformable element may for example be constituted by or include polyurethane.

When using the process and system according to the first and second aspects to form a workpiece into a component or product which for example may be used in the aerospace and automotive industries, the shape of the forming surface of the forming tool may correspond to, or substantially correspond to, the shape of the component or product.

The pressure generator may be configured to exert a forming pressure in a pressure range of (about) 5 MPa to (about) 200 MPa (i.e., 50 bar to 2000 bar) on the elastically deformable element and/or the forming tool. Preferably, the pressure generator may be configured to exert a forming pressure in a pressure range of (about) 50 MPa to (about) 200 MPa on the elastically deformable element and/or the forming tool. According to another example, the pressure generator may be configured to exert a forming pressure in a pressure range of (about) 5 MPa (or 50 MPa) to (about) 140-150 MPa on the elastically deformable element and/or the forming tool.

The at least one of the workpiece or the forming tool may for example be heated such that the temperature of the at least one of the workpiece or the forming tool during forming of the workpiece is between (about) 200° C. and (about) 500° C., such as between 250° C. and 350° C., or preferably between 250° C. and 300° C.

The previously mentioned experimental studies which have been carried out by the Applicant have indicated that such 'flexible' forming—when carried out using a forming pressure in a pressure range of (about) 50 MPa to (about) 200 MPa, and with the workpiece and/or the forming tool is/are heated such that the temperature thereof during the forming of the workpiece is between (about) 200° C. and (about) 500° C., preferably between 250° C. and 350° C., or even more preferably between 250° C. and 300° C.—may be particularly advantageous in facilitating or allowing for forming of workpieces made of composites or metallic alloys, such as titanium alloys, wherein the thus formed workpieces—or components—have a sufficient quality for example for use in the automotive or aerospace industry.

According to the first and second aspects, the heating of at least one of the workpiece or the forming tool such that the temperature of the at least one of the workpiece or the forming tool, during the forming of the workpiece by way of the forming pressure, is higher than the ambient temperature. This may entail that the workpiece and/or forming tool may be heated prior to the actual forming of the workpiece taking place, and that the workpiece and/or forming tool may be in a heated state as compared to the ambient while the actual forming by way of the forming pressure is taking place.

As indicated in the foregoing, the side of the workpiece facing the forming tool and the forming surface may be caused to be pressed against each other, such that the workpiece is formed at least in part in accordance with the shape of the forming surface so as to obtain a formed workpiece, by pressurization of the side of the elastically deformable element, by pressurization of the forming tool (e.g., of a side or surface thereof, such as a surface opposite to the forming surface), or by pressurization of both the side of the elastically deformable element and the forming tool. In the context of the present application, by pressurization of a side or surface of an element, it is meant that pressure is applied over at least a portion of the side or surface of the element, or even over the entire, or substantially the entire, side or surface of the element.

In the context of the present application, by the workpiece being formed at least in part in accordance with the shape of the forming surface, it is meant that at least a part or portion of the workpiece is formed substantially or even completely in accordance with the shape of the surface of the forming tool, or so as to substantially or even completely match the shape of the forming surface of the forming tool. However, it is to be understood that depending on the application, an exact match between the formed workpiece and the shape of the forming surface of the forming tool may not be required.

In the context of the present application, by ambient temperature it is meant the temperature of the general surroundings of the location at which the forming of the workpiece is carried out. For example, if the forming of the workpiece is carried out inside a room of a building or structure, the ambient temperature may be the temperature of air inside the room when the forming of the workpiece is carried out.

As mentioned in the foregoing, the pressure generator may be configured to exert a forming pressure on the elastically deformable element and/or the forming tool so as to pressurize at least one of one side of the elastically deformable element opposite to the side of the elastically deformable element facing the workpiece, or the forming tool. It is to be understood that the one side of the elastically deformable element, which side may be pressurized and is opposite to the side of the elastically deformable element facing the workpiece, must not necessarily be exactly opposite to the side of the elastically deformable element facing the workpiece, but may be substantially opposite the side of the elastically deformable element facing the workpiece, or it may be located elsewhere as long as it allows for the forming of the workpiece by way of the forming pressure to be carried out.

In the context of the present application, by different elements or components, or sides thereof, facing each other (e.g., by a side of the workpiece facing the forming tool), it is meant that that the different elements or components, or sides thereof, are directed toward each other. Possibly, there may be one or more intermediate elements or components arranged between the different elements or components, or sides thereof, facing each other. For example, as will be described further in the following, a thermally insulating element—for example constituted by a thermally insulating lid (or other closure means) or cover—may be arranged between the workpiece and the elastically deformable element, or between the workpiece and the side of the elastically deformable element facing the workpiece, (at least) during the forming of the workpiece.

A thermally insulating element may be arranged between the workpiece and the elastically deformable element such that the thermally insulating element is arranged adjacent to the workpiece and the elastically deformable element, respectively, so as to thermally insulate the elastically deformable element from the workpiece during the forming of the workpiece.

The forming tool and the workpiece may be arranged in a container comprising at least one opening, such that when the forming tool and the workpiece are arranged in the container, one side of the workpiece faces the forming tool and another side of the workpiece is directed towards the at least one opening. The workpiece and the forming tool may be heated when they are in the container. The container may be arranged in the press such that the other side of the workpiece, which is directed towards the at least one opening, is facing the elastically deformable element, wherein the forming of the workpiece using the press may be carried out while the forming tool and the workpiece are in the container. The thermally insulating element may be arranged relatively to the container such that the thermally insulating element at least in part closes the at least one opening of the container.

The heating of the at least one of the workpiece or the forming tool may for example be carried out using induction heating.

The heating of the at least one of the workpiece or the forming tool may be carried out in a heating device separately arranged with respect to the press.

The formed workpiece may be actively cooled.

The process may comprise at least one of trimming or shaving or sensing at least one dimension of the formed workpiece.

The elastically deformable element may for example be constituted by or include natural and/or synthetic rubber.

The system according may comprise a thermally insulating element arranged between the workpiece and the elastically deformable element such that the thermally insulating element is arranged adjacent to the workpiece and the elastically deformable element, respectively, so as to thermally insulate the elastically deformable element from the workpiece during forming of the workpiece.

The system may comprise a container comprising at least one opening. The container may be arranged to accommodate the forming tool and the workpiece such that when the forming tool and the workpiece are arranged in the container, one side of the workpiece faces the forming tool and another side of the workpiece is directed towards the at least one opening. The heating device may be configured to heat the workpiece and the forming tool when they are in the container. The container may be arrangeable in the press such that the other side of the workpiece, which is directed towards the at least one opening, is facing the elastically deformable element, wherein the forming of the workpiece using the press may be carried out while the forming tool and the workpiece are in the container.

At least a portion of the container may be thermally insulated.

The forming tool may be removably arranged in the press.

The elastically deformable element may comprise a resilient membrane or diaphragm. The pressure generator may be configured to controllably exert the forming pressure on the elastically deformable element by way of controllably supplying a pressure medium to a pressure cell in which the elastically deformable element is arranged, whereby the pressure medium pressurizes the one side of the elastically deformable element.

The elastically deformable element may comprise a pad or cushion. The pressure generator may be configured to controllably exert the forming pressure on the elastically deformable element by controllably pressing the elastically deformable element against the workpiece.

The workpiece may for example comprise at least one of: a blank, a plate, or sheet metal.

The workpiece may for example comprise a material selected from at least one of: at least one composite, aluminium or titanium or any alloy thereof, steel, nickel, or an alloy including nickel.

Further objects and advantages of the present invention are described in the following by means of exemplifying embodiments. It is noted that the present invention relates to all possible combinations of features recited in the claims. Further features of, and advantages with, the present invention will become apparent when studying the appended claims and the description herein. Those skilled in the art realize that different features of the present invention can be combined to create embodiments other than those described herein.

BRIEF DESCRIPTION OF THE DRAWINGS

Exemplifying embodiments of the present invention will be described below with reference to the accompanying drawings.

All the figures are schematic, not necessarily to scale, and generally only show parts which are necessary in order to elucidate embodiments of the present invention, wherein other parts may be omitted or merely suggested.

DETAILED DESCRIPTION

The present invention will now be described hereinafter with reference to the accompanying drawings, in which exemplifying embodiments of the present invention are shown. The present invention may, however, be embodied in many different forms and should not be construed as limited to the embodiments of the present invention set forth herein; rather, these embodiments are provided by way of example so that this disclosure will convey the scope of the present invention to those skilled in the art.

Figure 1:
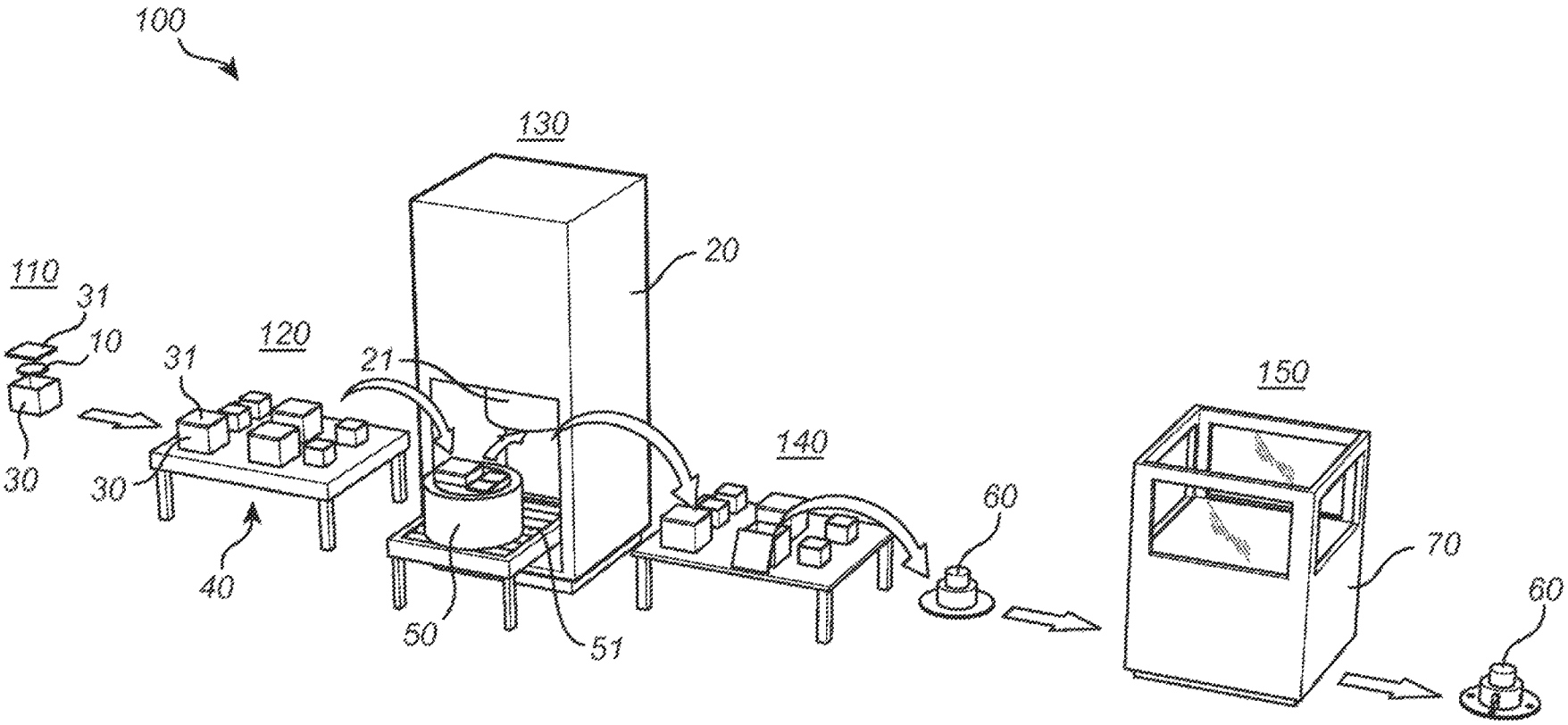
FIG. 1 is a schematic view illustrating a process according to an embodiment of the present invention.

FIG. 1 is a schematic view illustrating a process 100 according to an embodiment of the present invention. The process 100 is for forming of a workpiece 10 using a press 20. The process 100 may for example be used in order to form the workpiece 10 into a component or product which for example may be used in the aerospace and automotive industries. The press 20 comprises a pressure generator, schematically indicated at 21, a forming tool 22 (not shown in FIG. 1—cf. FIG. 2), and an at least in part elastically deformable element (not shown in FIG. 1). The shape of the forming tool 22 (and in particular its forming surface as described further in the following) may correspond to, or substantially correspond to, the desired or required shape of the component or product.

The process 100 comprises steps 110, 120, 130, 140 and 150 which will be described in the following. The arrows in FIG. 1 indicate the order in which the steps 110, 120, 130, 140 and 150 in the process 100 are carried out in accordance with the embodiment illustrated in FIG. 1.

At 110, a workpiece 10 is provided, which workpiece 10 is to be formed by way of the process 100. The workpiece 10 may for example comprise at least one of a blank, a plate, or sheet metal, but is not limited thereto. The workpiece 10 may for example comprise a material selected from at least one of: at least one composite, aluminium or titanium or any alloy thereof, steel, nickel, or an alloy including nickel, but is not limited thereto.

Figure 2:
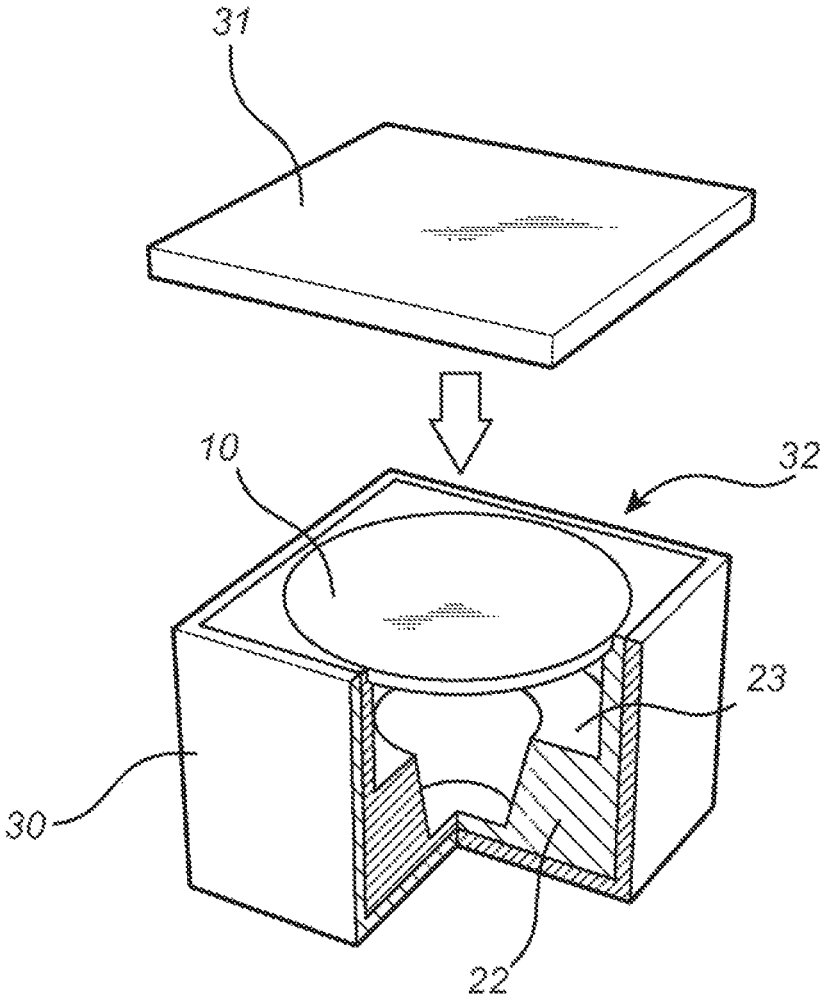
FIG. 2 is a schematic, in part sectional view of a container used in the process illustrated in FIG. 1.

In accordance with the illustrated embodiment of the present invention, a container 30 may be provided. As illustrated in FIG. 1, the container 30 may for example be shaped as a cube or a prism. The container 30 is arranged to accommodate the forming tool 22 and the workpiece 10. The container 30 may be at least in part hollow (i.e. it may include one or more cavities), and may comprise at least one opening e.g. for providing access for a user to the inside of the hollow part of the container 30. The at least one opening may be sized so as to allow for insertion and removal of the forming tool 22 and the workpiece 10 into and out of the container 30. Another way to describe the container 30 is that it may comprise a bottom and upstanding side walls, which side walls terminate at the top in a peripheral rim surrounding an upwardly directed opening. The container 30 is arranged to accommodate the forming tool 22 and the workpiece 10 such that when they are arranged in the container 30, one side of the workpiece 10 faces the forming tool 22 and another side of the workpiece 10 is exposed to the outside of the container 30 or directed towards the opening. Such an arrangement is illustrated in FIG. 2, which is a schematic, in part sectional view of the container 30 and which will be described in the following. The container 30 facilitates or allows for capability of shuttle movement of the assembly of the forming tool 22 and the workpiece 10, i.e. for movement of the assembly of the forming tool 22 and the workpiece 10 as a whole between one place and another. According to one or more embodiments of the present invention, the container 30 may be a part or portion of the forming tool 22, or vice versa.

At 120, the workpiece 10 and the forming tool 22 are heated. In accordance with the illustrated embodiment of the present invention, both the workpiece 10 and the forming tool 22 are heated. It is however to be understood that heating of both the workpiece 10 and the forming tool 22 may not be required, and it may be sufficient to heat only one of them (either the workpiece 10 or the forming tool 22). As per the embodiment of the present invention illustrated in FIG. 1, the workpiece 10 and the forming tool 22 are heated while they are situated in the container 30 (possibly by means of heating the container 30). At least a portion of the container 30 may be thermally insulated. It is however to be understood that the container 30 is not necessary and may be omitted, and that the workpiece 10 and/or the forming tool 22 may be heated while not being arranged in a container 30. Further in accordance with the illustrated embodiment of the present invention, the heating of the workpiece 10 and the forming tool 22 are heated is carried out by means of a heating device 40 in the form of an induction heating device (e.g., in the form of a so called induction table). However, it is possible to heat the workpiece 10 and/or the forming tool 22 by means of another type of heating device, such as, for example, any suitable heating device as known in the art. Induction heating devices provide a good controllability of the heating process. In order to attain the desired temperature of the workpiece 10 and/or the forming tool 22, temperature sensors (not shown in FIG. 1) may be arranged to sense temperature at different locations on the workpiece 10 and/or forming tool 22 during the heating thereof. Since induction heating devices are as such well known in the art, they will not be described further herein.

As illustrated in FIG. 2, a thermally insulating element 31, e.g. in the form of a thermally insulating lid 31 or other closure means, may be placed over the opening 32 of the container 30 so as to reduce or even minimize thermal losses during subsequent handling of the container 30 in the process 100, such as during transportation of the container 30 to the press 20. The thermally insulating element 31 or thermally insulating lid 31 may be used to (substantially) completely or in part close the opening 32 container 30. The thermally insulating element 31 or thermally insulating lid 31 may provide thermal insulation between the elastically deformable element and the workpiece 10 during the forming of the workpiece 10.

As illustrated in FIG. 1, the heating device 40 may be configured to heat several workpieces and possibly corresponding forming tools at the same time. Any other workpiece and corresponding forming tool which may be heated by the heating device 40 may also be arranged in a container, such as illustrated in FIG. 1.

As illustrated in FIGS. 1 and 2, the forming tool 22 may be removably arranged in the press 20. Thus, the forming tool 22 may be exchanged for another forming tool, which for example may exhibit a different shape of its forming surface, thereby facilitating or allowing for forming of workpieces into different shapes, as required or desired in different applications or scenarios. An example of a shape that the forming surface 23 may have is indicated in FIG. 2.

At 130, the heated workpiece 10 and the forming tool 22 are brought to the press 20 for forming of the workpiece 10 using the press 20 so as to obtain a formed workpiece 60. As illustrated in FIG. 1, the heated workpiece 10 and the forming tool 22 may be brought to the press 20 while the workpiece 10 and the forming tool 22 are still being situated in the container 30. The thermally insulating element 31 or thermally insulating lid 31 may possibly be removed prior to the forming of the workpiece 10 taking place. However, it may be preferred to not remove the thermally insulating element 31, so that it can provide thermal insulation between the elastically deformable element and the workpiece 10 during the forming of the workpiece 10.

The heating of the workpiece 10 and/or forming tool 22 may be carried out some period of time prior to the actual forming of the workpiece 10 by the press 20 takes place. Before the actual forming of the workpiece 10 is taking place, the workpiece 10 and/or the forming tool 22 may therefore cool to some extent, e.g., by means of convection during transportation or conveyance of the workpiece 10 and/or forming tool 22 to the press 20. However, by way of heating the workpiece 10 and/or forming tool 22 while taking into account such cooling and the time required to transport the workpiece 10 to the press 20 and begin the forming of the workpiece 10, the workpiece 10 and/or the forming tool 22 can have the desired temperature during the forming of the workpiece 10 in the press 20. In other words, the heating of the workpiece 10 and/or forming tool 22 may 'overshoot' to some extent. That is, immediately after the heating of the workpiece 10 and/or forming tool 22 has been carried out, the temperature of the workpiece 10 and/or forming tool 22 may be higher than the desired temperature of the workpiece 10 and/or forming tool 22 during the actual forming of the workpiece 10 by the press 20. Such 'overshoot' heating may take into account cooling of the workpiece 10 and/or the forming tool 22 that may take place until the actual forming of the workpiece 10 by the press 20 takes place, such that the temperature of the workpiece 10 and/or forming tool 22 during the actual forming of the workpiece 10 by the press 20 is the desired or required temperature.

As indicated in FIG. 1, several workpieces may be processed in the press 20 at the same time. The workpiece 10 and the forming tool 22 and possibly any other workpiece and corresponding forming tool may be arranged in a transportation and handling unit 50—or 'shuttle'—which shuttle 50 is inserted into the press 20 in order for the workpiece 10 and any other workpieces to be processed in the press 20. As illustrated in FIG. 1, the shuttle 50 may for example be transported into the press 20 by way of a conveyor belt 51 or similar means. Once the shuttle 50 has been transported into the press 20, the workpiece 10 may in principle be ready to be subjected to forming in the press 20. That is, the workpiece 10 may be subjected to forming in the press 20 while the workpiece 10 is still situated in the shuttle 50. Such functionality is for example provided in presses of the so called Flexform—or fluid cell forming—type of presses for sheet metal forming which are produced by the Applicant.

During forming of the workpiece 10 in the press 20, the workpiece 10 is arranged adjacent to the forming tool 22 and the elastically deformable element, and between one side of the elastically deformable element and a forming surface 23 of the forming tool 22 so that one side of the workpiece 10 faces the elastically deformable element and another side of the workpiece 10 faces the forming tool 22.

As illustrated in FIG. 1, the container 30 can be arranged in the press 20 such that the side of the workpiece 10 that is directed towards the opening of the container 30 is facing the elastically deformable element, wherein the forming of the workpiece 10 using the press 20 is carried out while the forming tool 22 and the workpiece 10 are in the container 30 (and possibly also in the shuttle 50). That is, the forming tool 22 and the workpiece 10 may be in the container 30 (and possibly also in the shuttle 50) during the forming of the workpiece 10 using the press 20.

According to the illustrated embodiment of the present invention, the pressure generator 21 is configured to (possibly controllably) exert a forming pressure of at least 5 MPa on the elastically deformable element so as to pressurize one side of the elastically deformable element opposite to the side of the elastically deformable element facing the workpiece 10. The pressurization of the side of the elastically deformable element causes the elastically deformable element to deform so as to cause the side of the workpiece 10 facing the forming tool 22 to be pressed against the forming surface 23 such that the workpiece 10 is formed at least in part in accordance with the shape of the forming surface 23. The heating of the workpiece 10 and the forming tool 22 is such that the temperature of the workpiece 10 and the forming tool 22, during the forming of the workpiece 10 by way of the forming pressure, is higher than the ambient temperature. The heating of the workpiece 10 and the forming tool 22 may take into account any cooling of the workpiece 10 and/or the forming tool 22 which may take place during transportation of the workpiece 10 and the forming tool 22 to the press 20 and until the forming of the workpiece 10 can take place.

The pressure generator 21 could for example comprise a hydraulic ram assembly or at least one hydraulic cylinder, which for example may be mechanically connected or coupled to the elastically deformable element. It is however to be understood that another type or other types of pressure generators may be employed, such as, for example, any suitable pressure generator as known in the art. The elastically deformable element may for example comprise a resilient membrane or diaphragm, a pad, or a cushion such as described in the foregoing. The elastically deformable element may for example be constituted by or include natural and/or synthetic rubber.

Figure 3:
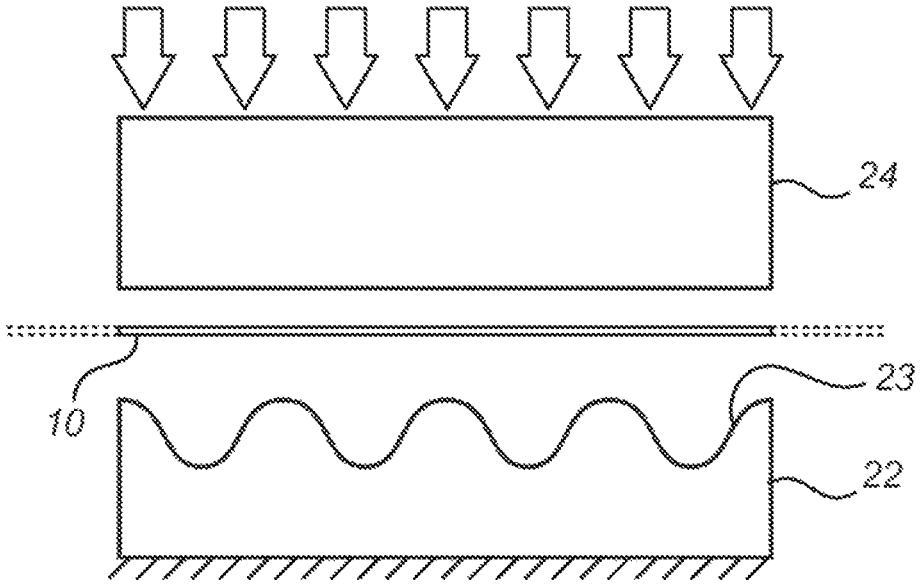
FIGS. 3 and 4 are schematic side views of parts of a press and a workpiece in accordance with an embodiment of the present invention.
Figure 4:
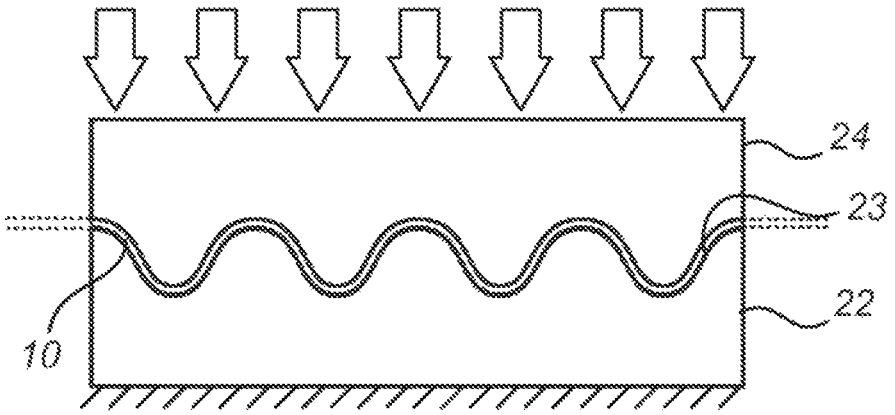

The principle of such 'flexible' forming of the workpiece 10 as described in the foregoing is illustrated in FIGS. 3 and 4.

FIGS. 3 and 4 are very schematic side views of the elastically deformable element 24, the workpiece 10 and the forming tool 22 during forming of the workpiece 10 using the press 20 in accordance with an embodiment of the present invention. FIGS. 3 and 4 illustrate the case where the elastically deformable element 24 comprises a pad or cushion such as described in the foregoing. The elastically deformable element 24 may for example be constituted by or include natural and/or synthetic rubber.

According to the example illustrated in FIGS. 3 and 4, the forming surface 23 of the forming tool 22 is an undulating one. In other words, the forming surface 23 illustrated in FIGS. 3 and 4 exhibits a wavy form or appearance. However, it is to be understood that this particular shape of the forming surface 23 of the forming tool 22 illustrated in FIGS. 3 and 4 is according to an example for illustrating principles of an embodiment of the present invention, and is not limiting. The forming surface 23 of the forming tool 22 may in principle have any shape as required or desired by the application or circumstances. Another example of the shape of the forming surface 23 of the forming tool 22 is indicated in FIG. 2.

During forming of the workpiece 10 in the press 20, the workpiece 10 (comprising for example a metallic plate or sheet metal) is placed in the press 20 such that the workpiece 10 is arranged adjacent to the forming tool 22 and the elastically deformable element 24, and between one side of the elastically deformable element 24 (the lower side thereof in FIG. 3) and a forming surface 23 of the forming tool 22 so that one side of the workpiece 10 faces the elastically deformable element 24 (the upper side of the workpiece 10 in FIG. 3) and another side of the workpiece 10 faces the forming tool 22 (the lower side of the workpiece 10 in FIG. 3).

As indicated in FIG. 3, the elastically deformable element 24 is then pressed towards the workpiece 10 by means of the pressure generator 21 (not shown in FIG. 3 or 4) exerting a forming pressure on the elastically deformable element 24 so as to pressurize one side of the elastically deformable element 24. The pressurization of the side of the elastically deformable element 24 is indicated in FIG. 3 by the arrows directed towards the elastically deformable element 24. The pressure generator 21 may for example comprise a hydraulic ram assembly (not shown in FIG. 3 or 4) that is mechanically connected to the elastically deformable element 24. By the deformability of the elastically deformable element 24, the elastically deformable element 24 may due to the pressurization be deformed so as to cause the lower side of the workpiece 10 to be pressed against the forming surface 23 of the forming tool 22 such that the workpiece 10 is formed substantially or even completely in accordance with the shape of the forming surface 23 of the forming tool 22. FIG. 4 illustrates a state of the workpiece 10 where the workpiece 10 has been formed (substantially) completely in accordance with the shape of the forming surface 23 of the forming tool 22. If the forming pressure used is not sufficient to cause the workpiece 10 to become formed completely in accordance with the shape of the forming surface 23 of the forming tool 22, the forming pressure may if required be further increased so as to increase the deformation of the elastically deformable element 24 so that the workpiece 10 is formed completely in accordance with the shape of the forming surface 23 of the forming tool 22. Thus, by deformation of the elastically deformable element 24 so as to cause the lower side of the workpiece 10 to be pressed against the forming tool 22, the elastically deformable element 24 may form the workpiece 10 into and around any surface features of the forming surface 23 of the forming tool 22. The pressure generator 21 may be configured to (possibly controllably) exert the forming pressure on the elastically deformable element 24 by (controllably) pressing the elastically deformable element 24 against the workpiece 10 (e.g., by controlling the pressing force applied to the elastically deformable element 24 by a hydraulic ram assembly). The forming pressure on the elastically deformable element 24 may hence be controlled by controlling the operation of the pressure generator 21 with respect to the pressing force that is applied to the elastically deformable element 24. The pressure generator 21 may be configured to maintain the forming pressure during a selected or predefined period of time, such as, for example, (about) one minute or a few minutes.

For the case illustrated in FIGS. 3 and 4, where the elastically deformable element 24 comprises a pad or cushion that may be constituted by or include natural and/or synthetic rubber, it may be preferable to use a maximum forming pressure of about 300 bar to 500 bar, since a rubber pad or cushion may not be able to cope with higher forming pressures without being damaged or broken.

Depending on the extent or degree to which the workpiece 10 and/or the forming tool 22 is heated, it may be desired or possibly even required to provide thermal insulation, for example between the elastically deformable element 24 and the workpiece 10. That is to say, in case the workpiece 10 and/or the forming tool 22 are heated to a relatively high temperature for the forming of the workpiece 10, thermal insulation for example between the elastically deformable element 24 and the workpiece 10 may be desired or even required. For example, there may be a limit on how much the elastically deformable element 24 can be heated without being damaged or broken. Whether such thermal insulation should or shall be provided may for example depend on the choice of material(s) which the elastically deformable element 24 is made of, the type of elastically deformable element 24 (e.g., whether a resilient membrane or diaphragm or a pad is employed), or the choice of any possible pressure medium which may be used (in case the press 20 is of pressure cell type). Such thermal insulation can for example be provided by a thermally insulating element 31, e.g. comprising a thermally insulating lid 31, such as described in the foregoing with reference to FIGS. 1 and 2. Such a thermally insulating lid 31 may hence, according to one or more embodiments of the present invention, not be removed prior to the forming of the workpiece 10 taking place, but may be arranged between the workpiece 10 and the elastically deformable element 24 (at least) during the forming of the workpiece 10, so as to thermally insulate the elastically deformable element 24 from the workpiece 10 during the forming of the workpiece 10. The thermally insulating element 31 or thermally insulating lid 31 may for example be made of an elastically deformable material, similarly to the elastically deformable element 24, and/or a resilient or flexible material. The thermally insulating element 31 or thermally insulating lid 31 may for example comprise silicone rubber, or a material similar to silicone rubber (e.g., having similar thermal and mechanical properties).

As mentioned in the foregoing, the press 20 could in alternative be constituted by or include a press of pressure cell type, wherein an elastically deformable element in the form of a resilient membrane or diaphragm is utilized for forming the workpiece by way of fluid pressure pressurizing the resilient membrane or diaphragm, such as described in the foregoing. The press 20 could for example be constituted by, or be based on, a press of pressure cell type of the so called Flexform—or fluid cell forming—type of presses for sheet metal forming which are produced by the Applicant. Such type of presses are capable of providing a very high controllability in the forming pressure, and may permit forming pressures within a wide pressure range, such as between (about) 80 MPa and (about) 200 MPa or even more.

Thus, the pressure generator 21 may in alternative or in addition comprise a pressure cell (not shown in FIGS. 3 and 4) in which the elastically deformable element is arranged. The elastically deformable element may comprise a resilient membrane or diaphragm. The pressure generator 21 may be configured to (possibly controllably) exert the forming pressure on the elastically deformable element by way of (controllably) supplying a pressure medium to the pressure cell in which the elastically deformable element is arranged, whereby the pressure medium pressurizes the side of the elastically deformable element that is opposite to the side of the elastically deformable element facing the workpiece. Thereby, the elastically deformable element may be caused to deform so as to cause the side of the workpiece facing the forming tool to be pressed against the forming surface such that the workpiece is formed at least in part in accordance with the shape of the forming surface. The forming pressure on the elastically deformable element may hence be controlled by controlling the amount of pressure medium supplied to the pressure cell.

With further reference to FIG. 1, the heating of the workpiece 10 and/or the forming tool 22 may be carried out in a heating device 40 which is separately arranged with respect to the press 20. However, it is to be understood that the press 20 and the heating device 40 in accordance with one or more embodiments of the present invention could be constituted by a single device which may provide both the pressing capability and the heating capability.

At 140, the formed workpiece 60 is cooled. Although the cooling of the formed workpiece 60 is indicated in FIG. 1 to be carried out by the formed workpiece 60 being passively cooled, e.g., while resting on a table, the formed workpiece 60 may instead be actively cooled by means of some appropriate cooling technique or means e.g. such as known in the art. The active cooling may for example be carried out in order to rapidly cool—or quench—the formed workpiece 60. As known in the art, quenching of a workpiece may for example avoid undesired low-temperature processes such as phase transformations from occurring in the workpiece. Quenching may for example comprise soaking or immersing the formed workpiece 60 in a fluid, e.g., in a gas such as air or nitrogen or noble gases, or in a liquid such as water (not shown in FIG. 1). The cooling at 140 is not required and may be omitted.

At 150, the formed workpiece 60 may be trimmed and/or shaved, by means of some trimming and/or shaving processing equipment for example such as known in the art. The trimming and/or shaving processing equipment is schematically indicated at 70. As known in the art, shaving of a workpiece is to remove a relatively small amount of material from the edges of the workpiece for example to improve the finish of the edges of the workpiece or to attain a specific shape of the edges of the workpiece. And as further known in the art, trimming of a workpiece is to cut away excess or unwanted irregular features from the workpiece. For example, edges of the (semi-)formed workpiece 60 may be trimmed, if needed. The trimming or shaving at 150 is not required and may be omitted. In alternative or in addition, at least one dimension of the formed workpiece 60 may be measured or sensed at 150. There may for example be provided some appropriate means or a unit as known in the art configured to measure or sense at least one dimension of the formed workpiece 60. The means or a unit, which may be included in the equipment 70, may for example be an optically based means or unit, and may for example include one or more lasers. Based on the measurement or sensing of at least one dimension of the formed workpiece 60, margins of peripheral portions of the formed workpiece 60 may then for example be trimmed and/or shaved such as described in the foregoing, for example in order to improve the finish of the edges of the workpiece or to attain a specific shape or size (e.g., of the edges) of the workpiece. In alternative or in addition, any further forming of the workpiece at 150 that may take place may be carried out by hand, for example using a handheld tool.

Although not illustrated in FIG. 1, any transportation of the workpiece 10 and/or the formed workpiece 60 between any of the steps 110, 120, 130, 140 and 150 may for example be carried out using conveyor belts or similar means.

As indicated in FIG. 1, once the formed workpiece 60 has been trimmed and/or shaved at 150, the formed workpiece 60 may undergo further forming using the press 20 (the further forming may be 'cold' forming, or forming at an elevated temperature as described in the foregoing, and may possibly be carried out at a different forming pressure as compared to the previous forming), if needed. And as further indicated in FIG. 1, once the formed workpiece 60 has been cooled at 140, the formed workpiece 60 may undergo further forming using the press 20 (the further forming may be 'cold' forming, or forming at an elevated temperature as described in the foregoing, and may possibly be carried out at a different forming pressure as compared to the previous forming), if needed.

In conclusion, a process and a system for forming of a workpiece using a press comprising a pressure generator, a forming tool, and an at least in part elastically deformable element, are disclosed. At least one of the workpiece or the forming tool is heated, and the workpiece is formed using the press so as to obtain a formed workpiece. The heating of at least one of the workpiece or the forming tool is such that the temperature of the at least one of the workpiece or the forming tool during the forming of the workpiece by way of forming pressure generated by the pressure generator is higher than the ambient temperature.

While the present invention has been illustrated in the appended drawings and the foregoing description, such illustration is to be considered illustrative or exemplifying and not restrictive; the present invention is not limited to the disclosed embodiments. Other variations to the disclosed embodiments can be understood and effected by those skilled in the art in practicing the claimed invention, from a study of the drawings, the disclosure, and the appended claims. In the appended claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A process for forming of a workpiece using a press comprising a pressure generator, a forming tool, and an elastically deformable element, wherein, during forming of the workpiece, the workpiece is arranged adjacent to the forming tool and the elastically deformable element and between one side of the elastically deformable element and a forming surface of the forming tool so that one side of the workpiece faces the elastically deformable element and another side of the workpiece faces the forming tool, wherein the forming tool is removably arranged in the press, and wherein the pressure generator is configured to exert a forming pressure of at least 5 MPa on the elastically deformable element and/or the forming tool so as to pressurize at least one of one side of the elastically deformable element opposite to the side of the elastically deformable element facing the workpiece, or a surface of the forming tool opposite to the forming surface, thereby causing the elastically deformable element to deform so as to cause the side of the workpiece facing the forming tool and the forming surface to be pressed against each other such that the workpiece is formed at least in part in accordance with the shape of the forming surface, the process comprising:

arranging the forming tool and the work piece in a container comprising at least one opening, such that when the forming tool and the workpiece are arranged in the container, one side of the workpiece faces the forming tool and another side of the workpiece is directed towards the at least one opening;

heating the workpiece and the forming tool, wherein the heating of the workpiece and the forming tool is carried out when the workpiece and the forming tool are in the container;

arranging the container in the press such that the other side of the workpiece, which is directed towards the at least one opening, is facing the elastically deformable element;

forming the workpiece using the press so as to obtain a formed workpiece, wherein the forming of the work piece using the press is carried out while the forming tool and the workpiece are in the container;

wherein the heating of the workpiece and the forming tool is such that the temperature of at least one of the workpiece or the forming tool during the forming of the workpiece by way of the forming pressure is higher than the ambient temperature;

the process further comprising:

removing the container from the press with the forming tool and the formed workpiece still being in the container and with the elastically deformable element still being in the press.

2. A process according to claim 1, wherein the pressure generator is configured to exert a forming pressure in a pressure range of MPa to 200 MPa on at least one of the elastically deformable element and the forming tool.

3. A process according to claim 1, wherein the workpiece and the forming tool are heated such that the temperature of at least one of the workpiece or the forming tool during forming of the workpiece is between 200° C. and 500° C.

4. A process according to claim 1, wherein the workpiece and the forming tool are heated such that the temperature of at least one of the workpiece or the forming tool during forming of the workpiece is between 250° C. and 350° C.

5. A process according to claim 1, further comprising:

arranging a thermally insulating element between the workpiece and the elastically deformable element such that the thermally insulating element is arranged adjacent to the workpiece and the elastically deformable element, respectively, so as to thermally insulate the elastically deformable element from the workpiece during the forming of the workpiece.

6. A process according to claim 1, further comprising:

arranging a thermally insulating element relatively to the container such that the thermally insulating element at least in part closes the at least one opening of the container.

7. A process according to claim 1, wherein the heating of the workpiece and the forming tool is carried out using induction heating.

8. A process according to claim 1, wherein the heating the workpiece and the forming tool is carried out in a heating device separately arranged with respect to the press.

9. A process according to claim 1, further comprising actively cooling the formed workpiece.

10. A process according to claim 1, further comprising at least one of trimming or shaving or sensing at least one dimension of the formed workpiece.

11. A process according to claim 1, wherein the arranging of the container in the press such that the other side of the workpiece, which is directed towards the at least one opening, is facing the elastically deformable element, is such that the elastically deformable element is between the at least one opening and the forming tool and the workpiece during the forming of the workpiece.

12. A process according to claim 1, wherein the arranging of the forming tool and the workpiece in the container is such that the side of the workpiece facing the forming tool and the side of the workpiece directed towards the at least one opening are opposite sides of the workpiece.

13. A process according to claim 1, wherein the pressure generator is configured to exert a forming pressure in a pressure range of 50 MPa to 200 MPa on the at least one of the elastically deformable element and the forming tool, and the heating of the workpiece and the forming tool is such that the temperature of at least one of the workpiece or the forming tool during forming of the workpiece is between 250° C. and 350° C.

14. A system for forming of a workpiece, the system comprising:

a press comprising a pressure generator, a forming tool, and an elastically deformable element, wherein, during forming of the workpiece, the workpiece is arranged adjacent to the forming tool and the elastically deformable element and between one side of the elastically deformable element and a forming surface of the forming tool so that one side of the workpiece faces the elastically deformable element and another side of the workpiece faces the forming tool, wherein the forming tool is removably arranged in the press, and wherein the pressure generator is configured to exert a forming pressure of at least 5 MPa on the elastically deformable element and/or the forming tool so as to pressurize at least one of one side of the elastically deformable element opposite to the side of the elastically deformable element facing the workpiece, or a surface of the forming tool opposite to the forming surface, thereby causing the elastically deformable element to deform so as to cause the side of the workpiece facing the forming tool and the forming surface to be pressed against each other such that the workpiece is formed at least in part in accordance with the shape of the forming surface;

a heating device configured to heat the workpiece and the forming tool such that the temperature of at least one of the workpiece or the forming tool during the forming of the workpiece by way of the forming pressure is higher than the ambient temperature; and a container comprising at least one opening, the container being arranged to accommodate the forming tool and the workpiece such that when the forming tool and the workpiece are arranged in the container, one side of the workpiece faces the forming tool and another side of the workpiece is directed towards the at least one opening;

wherein the heating device is configured to heat the workpiece and the forming tool when they are in the container;

wherein the container can be arranged in the press such that the other side of the workpiece, which is directed towards the at least one opening, is facing the elastically deformable element, wherein the forming of the workpiece using the press is carried out while the forming tool and the workpiece are in the container;

wherein the container can be removed from the press with the forming tool and the formed workpiece still being in the container and with the elastically deformable element still being in the press.

15. A system according to claim 14, wherein the elastically deformable element is constituted by or includes at least one of natural and synthetic rubber.

16. A system according to claim 14, further comprising:

a thermally insulating element arranged between the workpiece and the elastically deformable element such that the thermally insulating element is arranged adjacent to the workpiece and the elastically deformable element, respectively, so as to thermally insulate the elastically deformable element from the workpiece during forming of the workpiece.

17. A system according to claim 16, wherein the thermally insulating element can be arranged relatively to the container such that the thermally insulating element at least in part closes the at least one opening of the container.

18. A system according to claim 16, wherein at least a portion of the container is thermally insulated.

19. A system according to claim 14, wherein the heating device is separately arranged with respect to the press.

20. A system according to claim 14, wherein the heating device comprises an induction heating device.

21. A system according to claim 14, wherein the elastically deformable element comprises a resilient membrane or diaphragm, wherein the pressure generator is configured to controllably exert the forming pressure on the elastically deformable element by way of controllably supplying a pressure medium to a pressure cell in which the elastically deformable element is arranged, whereby the pressure medium pressurizes the one side of the elastically deformable element.

22. A system according to claim 14, wherein the elastically deformable element comprises a pad or cushion, wherein the pressure generator is configured to controllably exert the forming pressure on the elastically deformable element by controllably pressing the elastically deformable element against the workpiece.

23. A system according to claim 14, the system comprising the workpiece, wherein the workpiece comprises at least one of: a blank, a plate, or sheet metal.

24. A system according to claim 14, the system comprising the workpiece, wherein the workpiece comprises a material selected from at least one of: at least one composite, aluminium or titanium or any alloy thereof, steel, nickel, or an alloy including nickel.

* * * * *